US007163109B2

(12) United States Patent
Wells et al.

(10) Patent No.: US 7,163,109 B2
(45) Date of Patent: Jan. 16, 2007

(54) METHOD AND APPARATUS FOR RETAIL DISPLAY OF CABINETS, COUNTERTOPS AND RELATED ITEMS

(75) Inventors: Andrew D. Wells, Jasper, IN (US); Rollin D. Weary, III, Northfield, IL (US)

(73) Assignees: MasterBrand Cabinets, Inc., Jasper, IN (US); Czarnowski Exhibit Service Specialists, Chicago, IL (US)

( * ) Notice: Subject to any disclaimer, the term of this patent is extended or adjusted under 35 U.S.C. 154(b) by 231 days.

(21) Appl. No.: 10/286,503

(22) Filed: Nov. 1, 2002

(65) Prior Publication Data

US 2003/0160009 A1 Aug. 28, 2003

Related U.S. Application Data

(60) Provisional application No. 60/336,429, filed on Nov. 1, 2001.

(51) Int. Cl.
*A47B 46/00* (2006.01)

(52) U.S. Cl. ..... 211/13.1; 211/189; 52/65; 312/305; 403/308

(58) Field of Classification Search ..... 211/13.1, 211/95, 163, 189, 187, 90.01, 184, 85.1, 35.2–35.7, 211/35.9–35.13, 36, 27, 42, 49.1; 312/245, 312/305, 249.2, 265.1, 265.2, 265.3, 265.4; 52/189, 27, 36.1; 403/177, 204, 305, 308
See application file for complete search history.

(56) References Cited

U.S. PATENT DOCUMENTS 3,834,093 A * 9/1974 Tacke et al. ..... 52/71
3,971,477 A * 7/1976 Bruderly et al. ..... 211/189
4,913,614 A * 4/1990 O'Rarden ..... 414/343
4,919,263 A * 4/1990 Baltzer et al. ..... 206/326
5,038,539 A * 8/1991 Kelley et al. ..... 211/190
5,415,301 A * 5/1995 Bruton et al. ..... 211/183
5,505,319 A * 4/1996 Todd, Jr. ..... 211/95
5,545,958 A * 8/1996 Kramer ..... 318/560
5,607,070 A * 3/1997 Hellyer ..... 211/189
5,609,402 A * 3/1997 Kemp ..... 312/265.4
5,611,442 A * 3/1997 Howard ..... 211/187
5,626,404 A * 5/1997 Kelley et al. ..... 312/198
5,642,593 A * 7/1997 Shieh ..... 52/239
5,660,287 A * 8/1997 Tryon ..... 211/186
5,870,867 A * 2/1999 Mitchell ..... 52/220.1
5,931,319 A * 8/1999 Murphy ..... 211/85.2
5,944,203 A * 8/1999 Vlah et al. ..... 211/189
5,971,169 A * 10/1999 Orr et al. ..... 211/95
6,102,502 A * 8/2000 Melillo et al. ..... 211/41.16
6,193,083 B1 * 2/2001 Wood ..... 211/189
6,193,085 B1 * 2/2001 Nook et al. ..... 211/187
6,230,902 B1 * 5/2001 Bird et al. ..... 211/13.1

(Continued)

*Primary Examiner*—Richard E. Chilcot, Jr.
*Assistant Examiner*—Jared W. Newton
(74) *Attorney, Agent, or Firm*—Calfee, Halter, & Griswold LLP

(57) ABSTRACT

A portable, modular apparatus for displaying fixtures and suites of fixtures in a commercial setting. The displayed fixtures can be cabinets, cabinets or the like and allow for display in a finished look to allow consumers to view the fixtures in a finished setting. A method of displaying fixtures and suites of fixtures in a commercial setting wherein the portions of the display are preassembled prior to in-store set up, thereby allowing quick and easy in-store set up of the display.

13 Claims, 11 Drawing Sheets

U.S. PATENT DOCUMENTS

D458,473 S * 6/2002 Steffensen ..... D6/461
6,467,637 B1 * 10/2002 Riga ..... 211/94.01
6,581,787 B1 * 6/2003 Barrett et al. ..... 211/59.2
6,585,118 B1 * 7/2003 Kellogg ..... 211/13.1
6,619,767 B1 * 9/2003 Conway ..... 312/234
6,659,295 B1 * 12/2003 De Land et al. ..... 211/187

* cited by examiner

FIG. 7
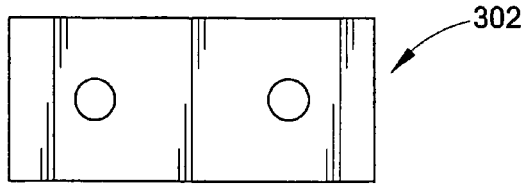
FIG. 7A
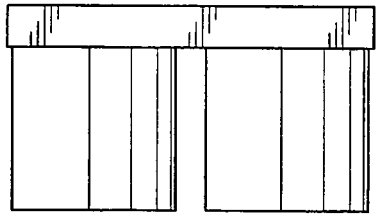
FIG. 7B
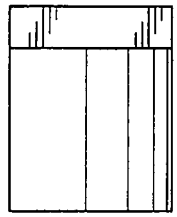
FIG. 7C
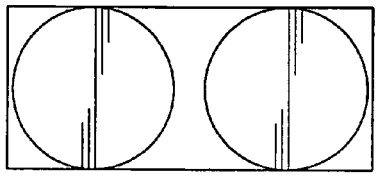
FIG. 7D
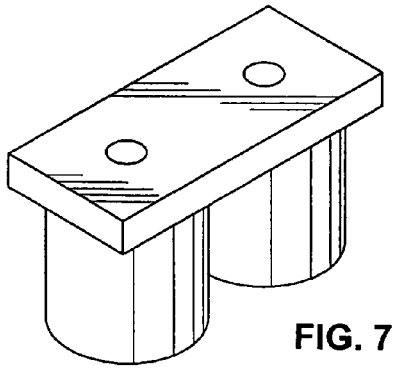
FIG. 7E

METHOD AND APPARATUS FOR RETAIL DISPLAY OF CABINETS, COUNTERTOPS AND RELATED ITEMS

CROSS-REFERENCE TO RELATED APPLICATIONS

This invention claims priority to U.S. Provisional Patent Application Ser. No. 60/336,429, filed Nov. 1, 2001.

FIELD OF THE INVENTION

The present invention relates to a method and apparatus for displaying fixtures and suites of fixtures; and more specifically to a method and apparatus for displaying cabinets, countertops, appliances, plumbing and plumbing fixtures in a commercial environment.

BACKGROUND

In a commercial environment, such as, for example, a retail store or wholesale establishment, it is desirable to display fixtures, more specifically arrangements of matched or related fixtures, or suites of fixtures, in a fashion that is appealing to the potential buyer. For example, kitchen and bathroom cabinets, countertops, appliances, plumbing, plumbing fixtures and the like are typically displayed in finished form in an arrangement where they appear as they would after installation in the home, office or other setting. Retailers often display finished cabinets, countertops and the like in complete kitchen or bathroom arrangements. Such an arrangement allows the customer to examine the product and determine how it will look when built and installed.

In order to provide customers with such displays, retail stores must construct the displays on the retail floor space. Frequently, a retail store desires to display multiple different fixture suites in a given floor space and, therefore, multiple displays must be constructed. Conventional methods entail construction of a display framework and attachment of the cabinets and related fixtures to the framework within the store at the location of the promotional display. To do this, retail stores must retain the services of many contractors, including for example, carpenters, electricians and plumbers, to come into the store and build the displays. Such construction disrupts valuable commercial floor space for a considerable amount of time prior to completion. Furthermore, there are the added inconveniences of on-site construction, such as, for example, noise, safety concerns, and debris from the construction. These factors prevent stores from easily switching or updating displays when new and/or improved cabinets become available on the market. Furthermore, display units are not always configured to minimize the amount of floor space allocated to a particular display or to maximize the attractiveness of the displays to the consumer. Therefore, there is a need for display systems that provide an efficient method of assembling and disassembly of the displays.

SUMMARY OF INVENTION

The present invention relates to a portable, modular display apparatus for fixtures and suites of fixtures, such as cabinets, countertops, appliances, plumbing, plumbing fixtures and the like. In one embodiment the display apparatus comprises a frame, a baseboard, and a set of display fixtures, such as cabinets, countertops or other fixtures and related items. In another embodiment, two or more display apparatuses can be arranged or attached together to display separate suites of fixtures in desired arrangements.

The present invention also relates to methods of displaying fixture suites in a commercial environment. In one embodiment, the method involves construction and assembly of the display apparatus off site, transportation of the apparatus to the commercial environment, and arrangement of the display in the commercial space. In another embodiment, the method involves construction and partial assembly of the display apparatus off site, transportation to the commercial environment, and arrangement of the display in the commercial space.

BRIEF DESCRIPTION OF THE DRAWINGS/PICTURES

FIG. 7 A-E shows pin frame connectors for attaching adjacent display units to one another.

Figure 8:
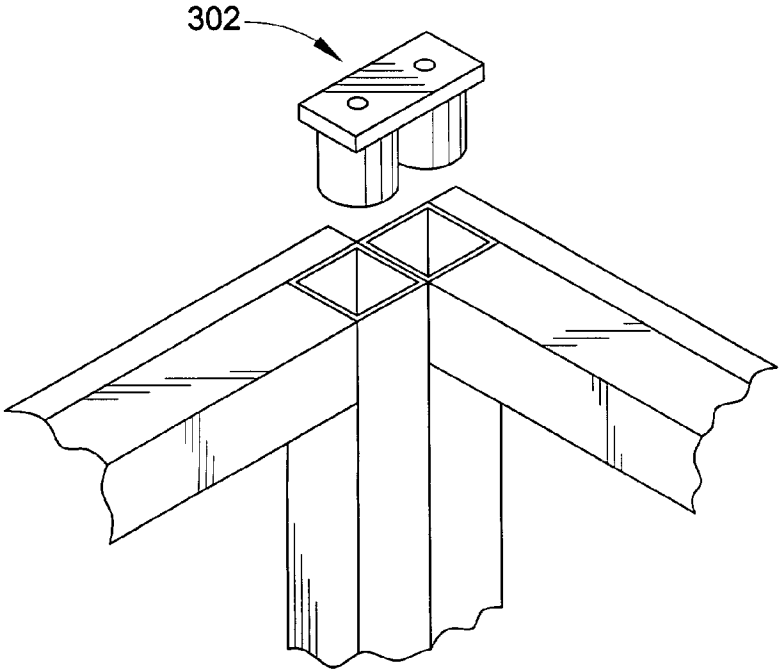

FIG. 8 shows pin frame connectors connecting two adjacent support bars of the frame.

Figure 9:
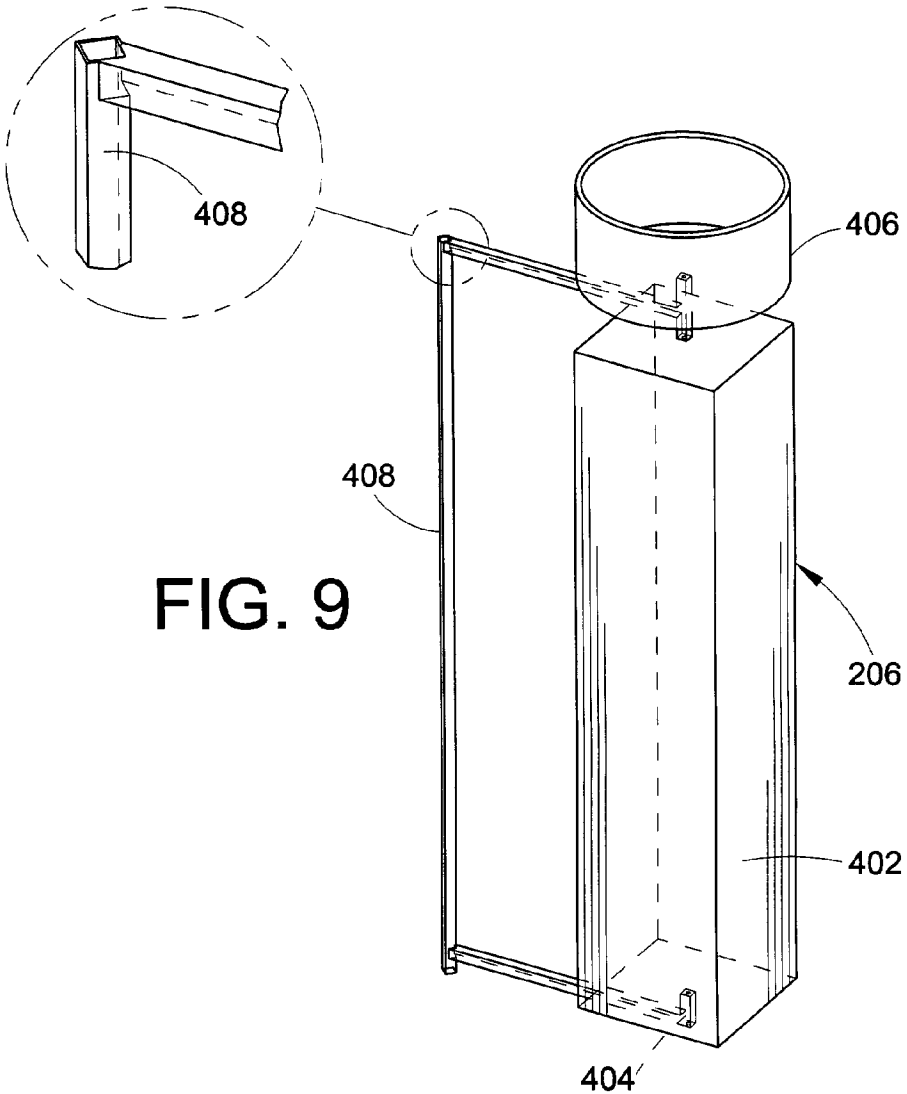

FIG. 9 is a view of an end cap.

Figure 10:
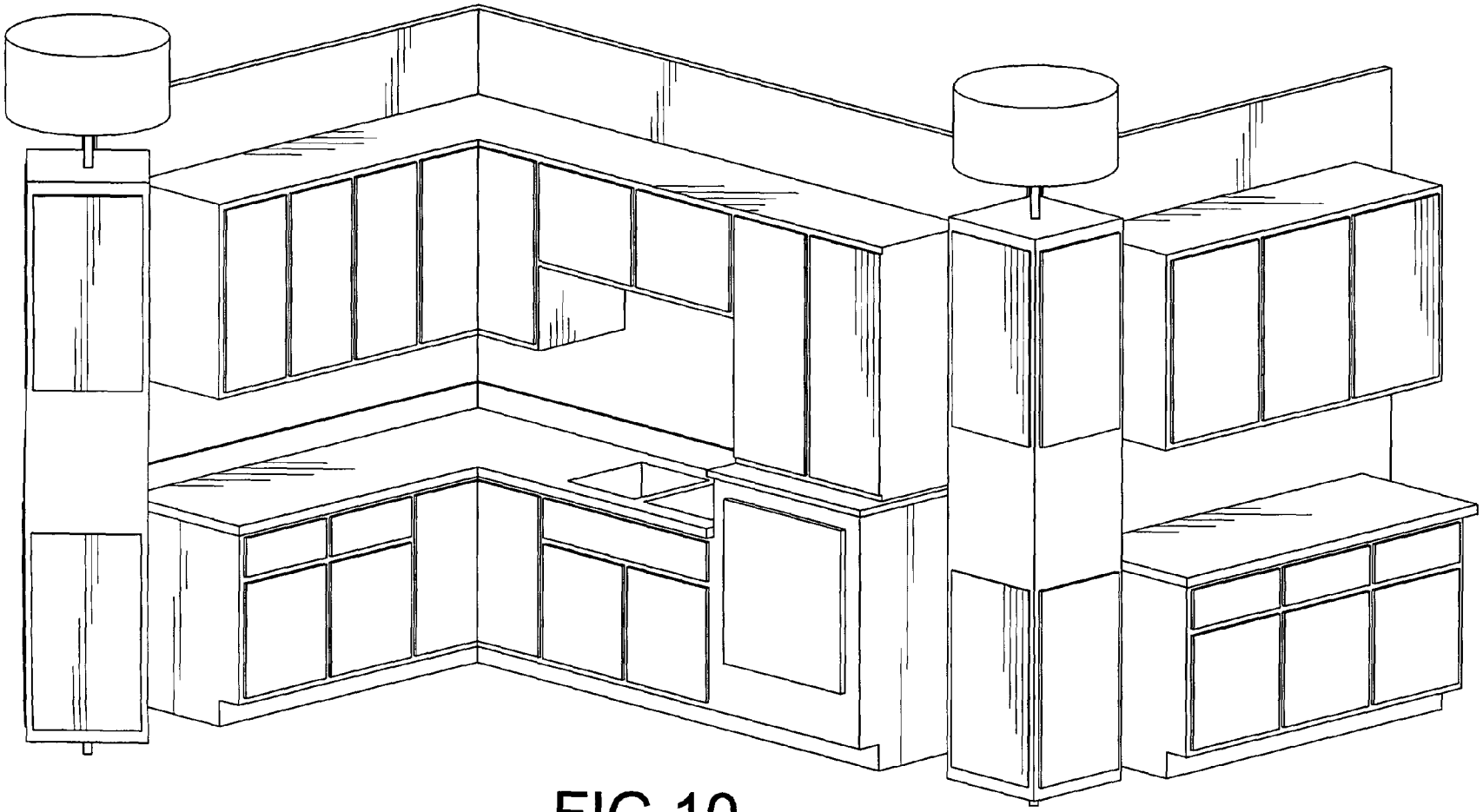
Figure 11:
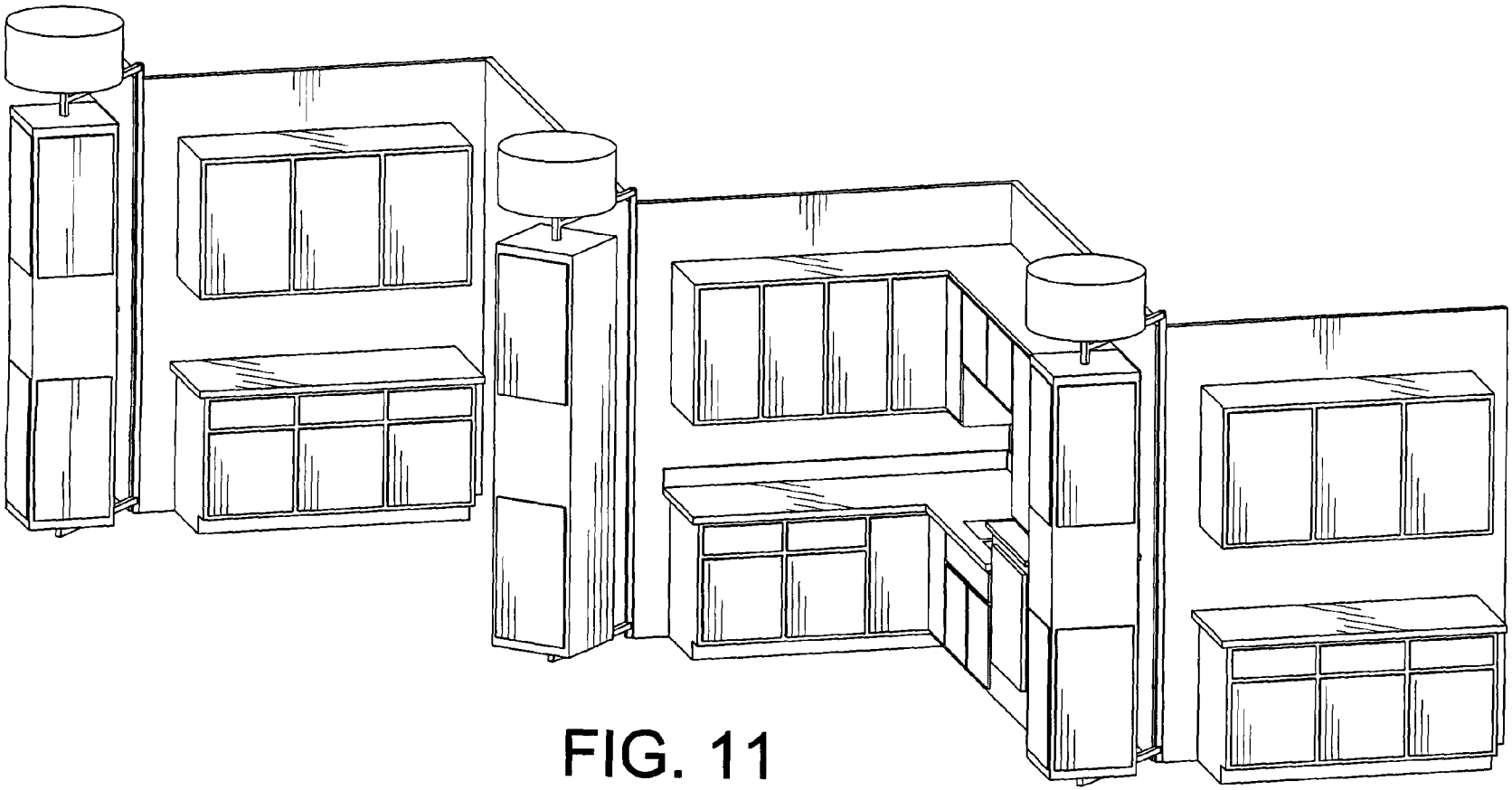

FIGS. 10 and 11 illustrate multiple display apparatuses attached together, each display showing a separate suite of fixtures.

Figure 12:
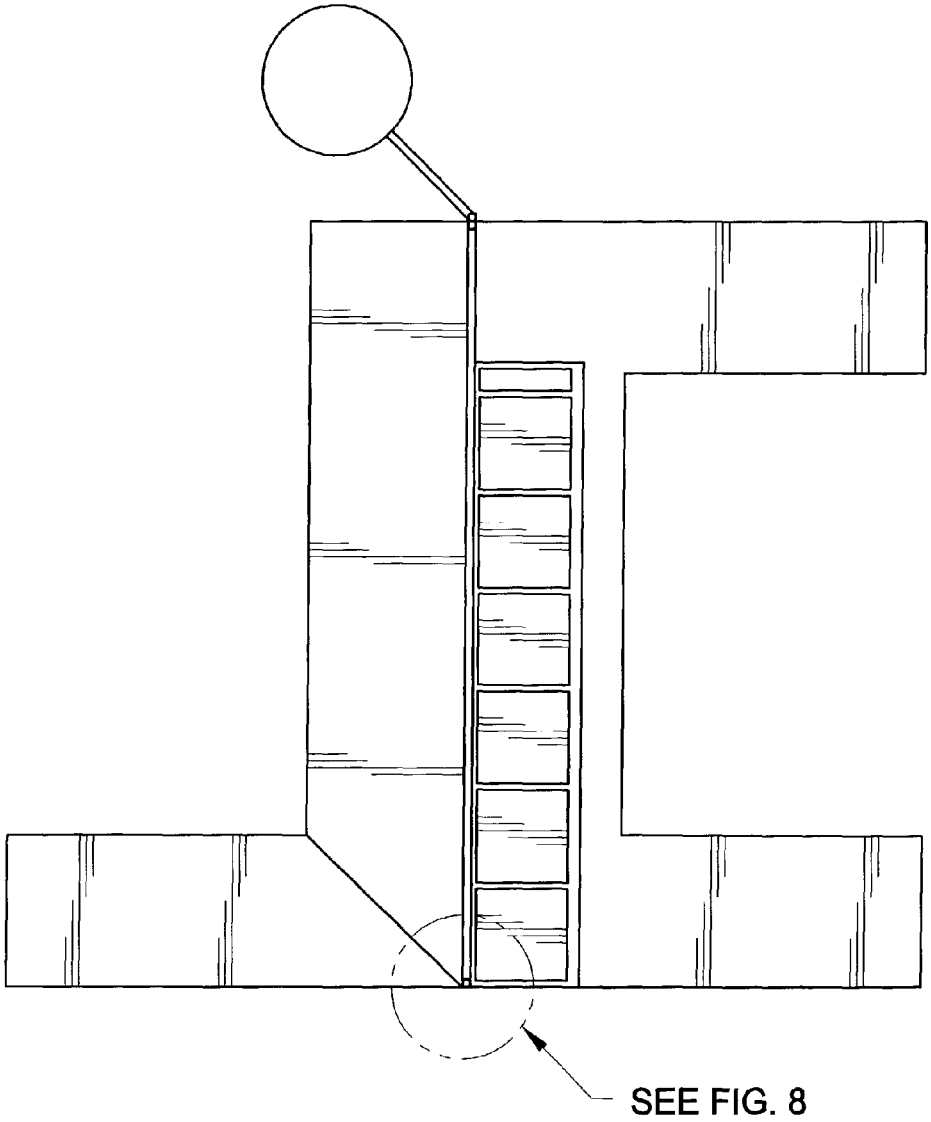

FIG. 12 illustrates a top view of a floor layout of multiple display apparatuses.

Figure 13:
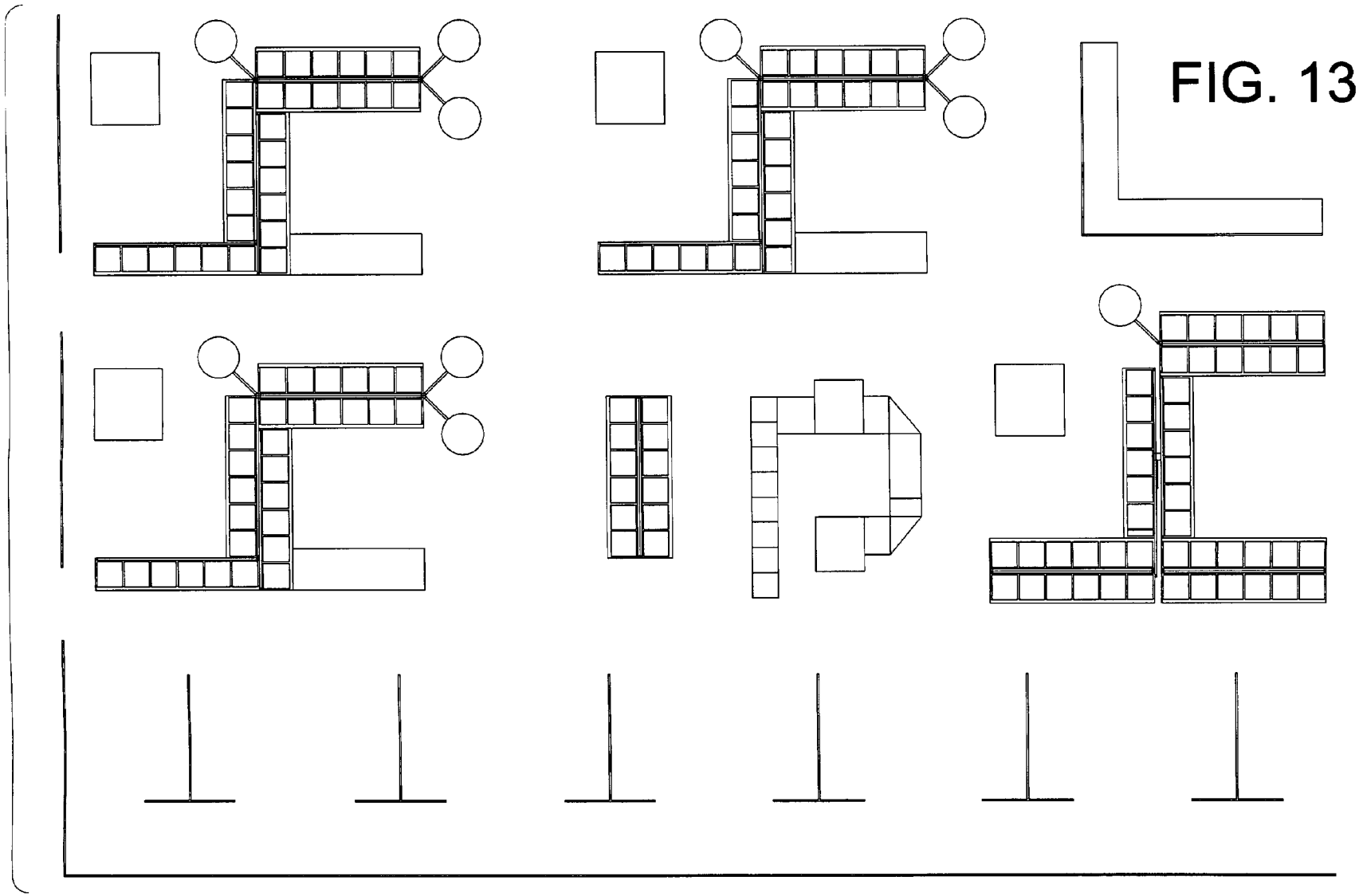

FIG. 13 illustrates a top view of a larger floor layout of multiple display apparatuses.

DETAILED DESCRIPTION

Figure 1:
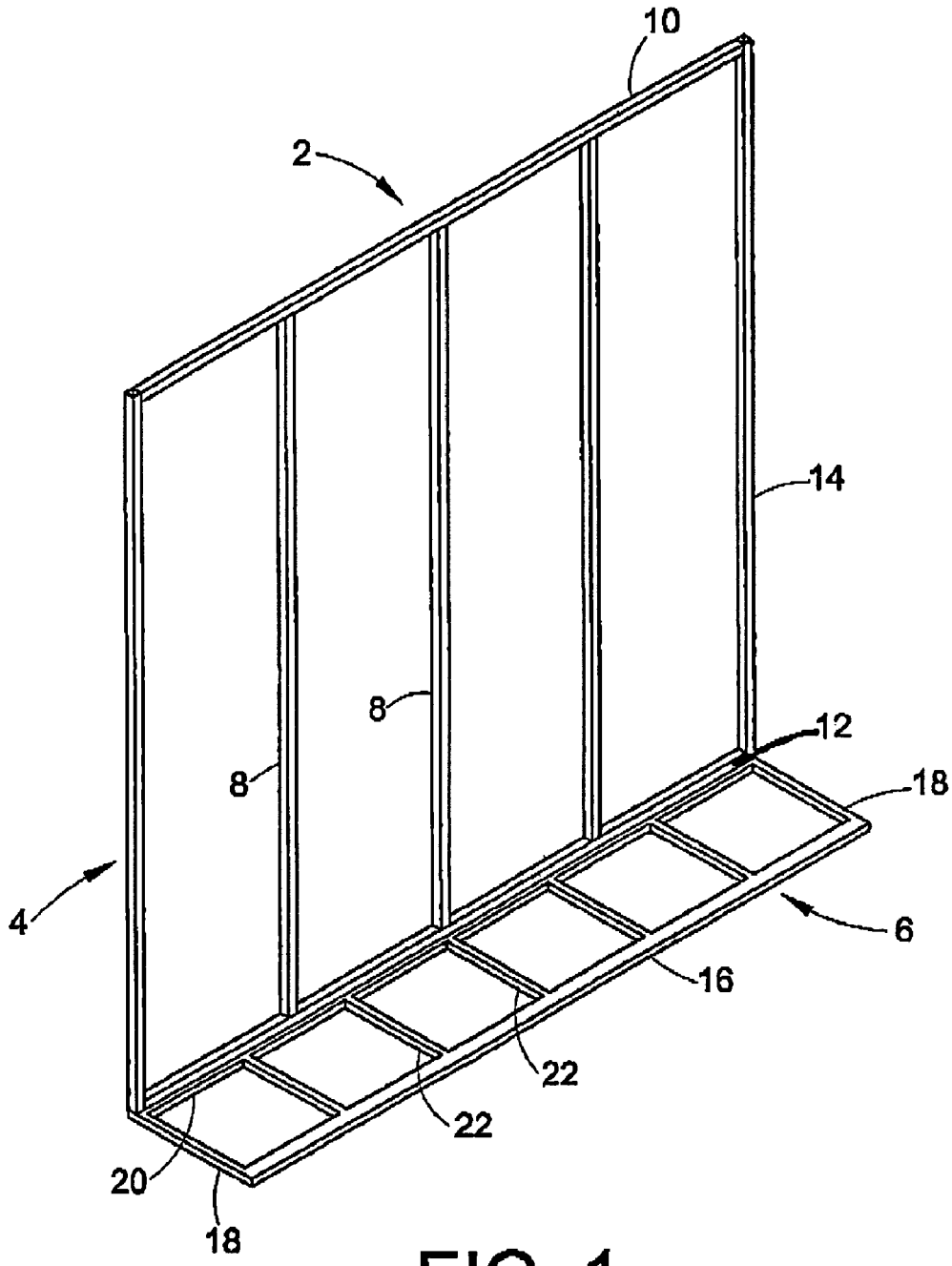
FIG. 1 illustrates the frame of the display apparatus.

The fixture display apparatus comprises a frame, a baseboard, and various display items or fixtures. The frame 2 (FIG. 1) has a display section 4 and a foot section 6. The display section 4 has spaced structural support bars 8 that are preferably parallel to one another and which extend from the floor, on which the display apparatus rests, vertically upward, forming a plane that is perpendicular to the floor. Optionally, there are top 10, bottom 12 and side 14 structural support bars that attach to and are preferably placed along the height or width of the display section 4 of the frame 2, within the plane formed by the vertically spaced structural support bars 8, but placed at an angle to them. These top 10, bottom 12 and side 14 structural support bars may form the edges of the display section 4 of the frame 2. The support bars 8 are typically made of a durable, strong metal, such as steel or aluminum, in order to provide strength and stability for the frame 2.

The foot section 6 of the frame 2 has a front bar 16 and two side bars 18. The foot section 6 may have an optional rear bar 20 and cross bars 22 that stabilize the foot section 6. The plane formed by the foot section 6 is placed parallel to the floor and is, in fact, placed so that it rests on the floor. So positioned on the floor, one edge of the display section 4 of the frame 2 is attached to the foot section 6 of the frame 2 and extends vertically upward from the foot section 6. Normally, a bottom support bar 12 of the display section 4 of the frame 2 attaches to the foot section 6 of the frame 2. Attachment of the display section 4 of the frame 2 to the foot section 6 of the frame 2 gives the display section 4 the support needed to extend vertically upward from the floor and to be free standing.

Figure 2:
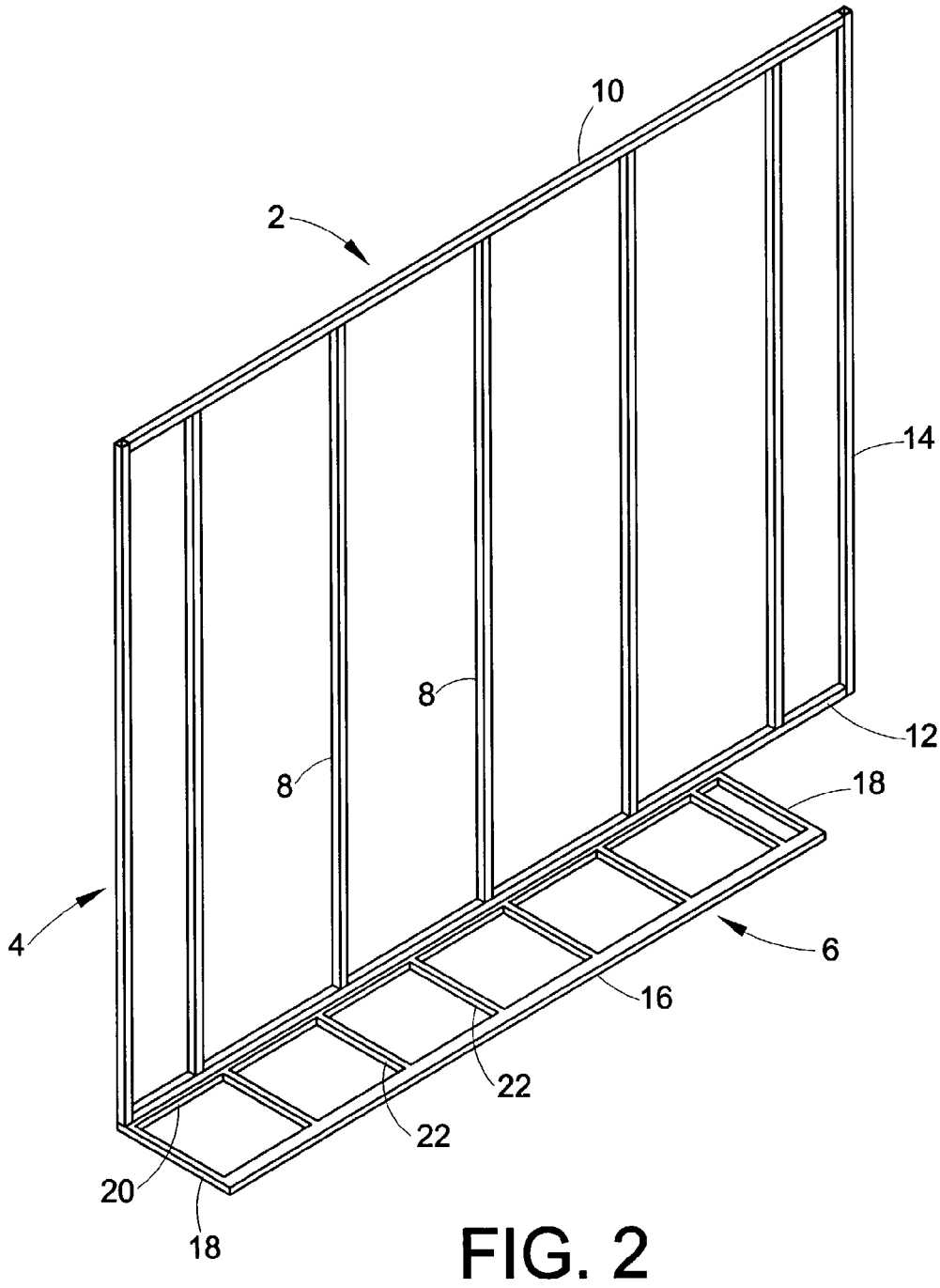
FIG. 2 illustrates the frame of a display apparatus where the foot section is recessed from the display section on one side of the frame.
Figure 3:
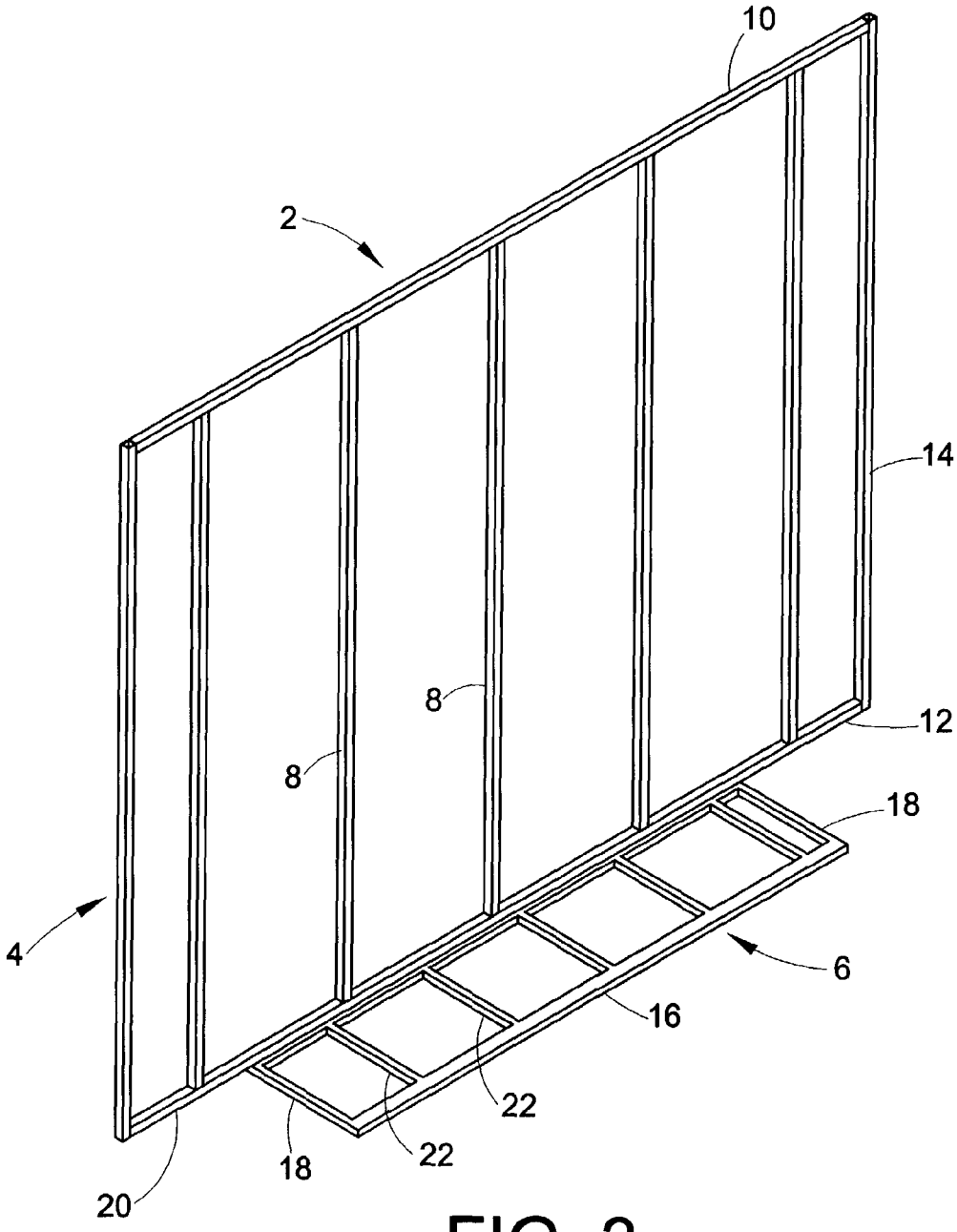
FIG. 3 illustrates the frame of a display apparatus where the foot section is recessed from the display section on both sides of the frame.

The width of both the display section 4 and the foot section 6 are normally the same and are typically built to be six, eight or ten feet wide. In other embodiments, however, the width of the foot section 6 of the frame 2 is not the same as the width of the display section 4. In one embodiment, the width of the foot section 6 is less than the width of the display section 4. FIG. 2 shows one such embodiment where the edges of the foot section 6 and display section 4 are aligned on one side of the frame 2 and offset on the other side of the frame 2. On the side of the frame 2 where there is offset, the foot section 6 is recessed from the edge of the display section 4 of the frame. In another embodiment, as shown in FIG. 3, the foot section 6 of the frame 2 is recessed from the edge of the display section 4 on both sides of the frame 2. In other embodiments, the width of the foot section 6 of the frame 2 is greater than the width of the display section 4. In such embodiments, there is also offset of the edges of the foot 6 and display section 4 on at least one side of the frame 2. In such embodiments, the foot section 6 is extended from at least one edge of the display section 4 of the frame 2. Frames that have recessed or extended foot sections 6 on one or both sides of the frame 2 are useful when separate display apparatuses are arranged at angles, right angles for example, to one another to form arrangements resembling a region of living space where two walls come together, as is discussed later. The recessed and/or extended foot sections 6 prevent overlap of foot sections 6 of separate frames 2 when the separate display apparatuses are arranged at angles to one another.

The height of the display section 4 is preferably from seven to twelve feet high. The depth of the foot section 6 of the frame 2 is preferably one and one-half to two feet. It should be appreciated that the shape, size and configuration of the frame 2 may vary and such variations are included within the scope of this application as defined by the claims attached hereto.

Figure 4:
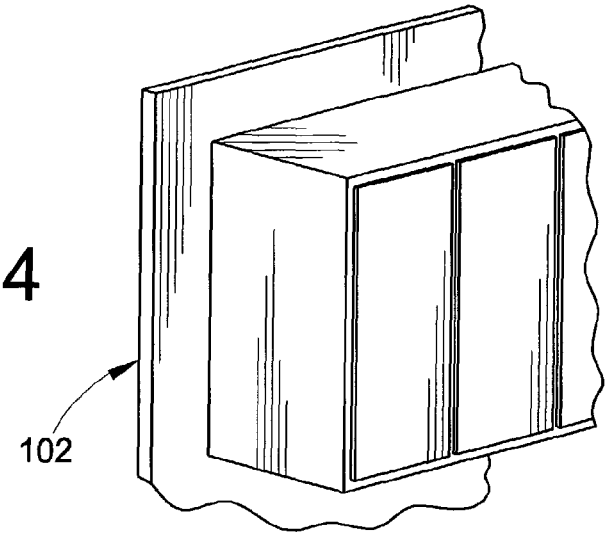
FIG. 4 is a close up view of the display showing the baseboard and attached cabinets.
Figure 5:
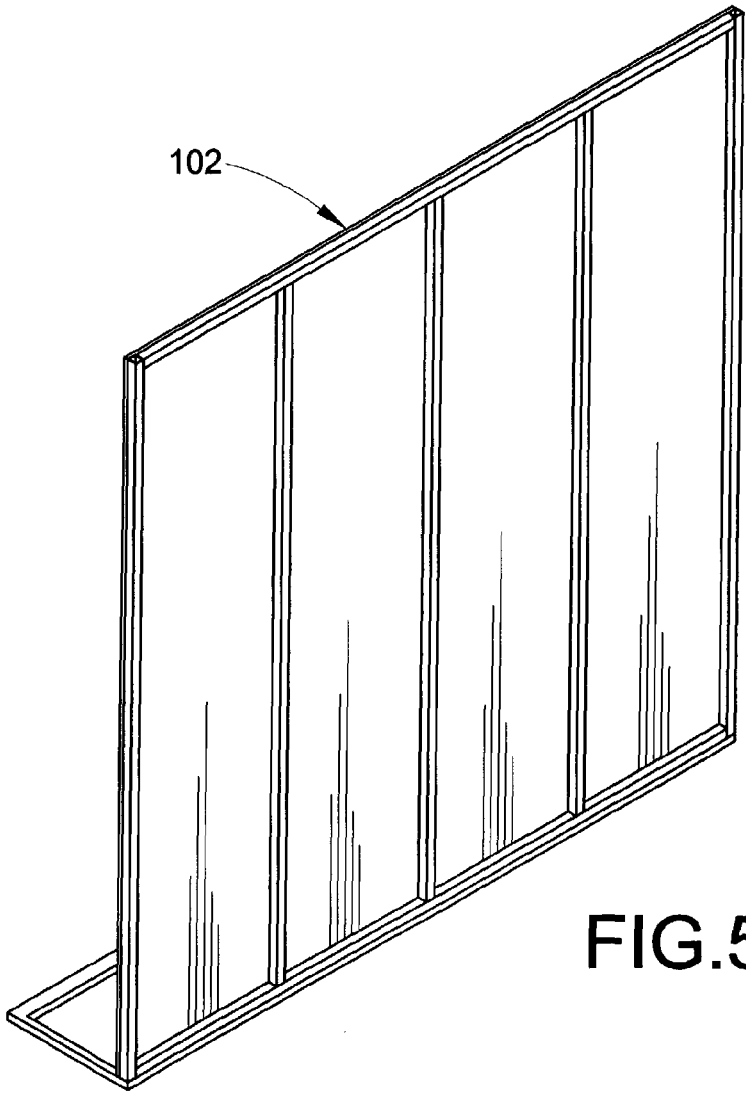
FIG. 5 illustrates the frame and overlying baseboard on the backside of a display.

As shown in the figures, particularly in FIGS. 4 and 5, the baseboard 102 is one or more solid sheets, typically of plywood or particle board, that fit over the front of the display section 4 of the frame 2 parallel to the plane formed by the display section 4 of the frame 2. Optionally, baseboards can be placed over the back of the display section 4 of the frame. The baseboard 102 is preferably attached to the frame 2 by a series of bolts, although other conventional fastening means can be used to affix the baseboard 102 to the frame 2. Securement of the baseboard 102 to the display section 4 of the frame 2 provides additional support to the display apparatus and provides a surface to which fixtures may be attached. In addition, the exterior surface of the baseboard 102 can be painted, wallpapered, or covered with any of a number of coverings, such as for example, fabric, paneling or tile, to provide a stylish surface. Attached to the baseboard 102 are optional display drawers or doors. Such drawers or doors can be used to hold promotional literature describing the displayed fixtures. Such drawers or doors can also be used to hold a computer station, as is described in the discussion of end caps, below.

The display items or fixtures may include furnishings and fittings that are normally attached to a structure, such as a living or working space. Examples of fixtures for the home or office include overhead or base cabinets, cupboards, shelves, drawers, vanities and countertops, refrigerators, dishwashers, microwave ovens and ranges, shelving systems, bookcases, sinks, toilets, showers, spas, lighting fixtures, safes, fireplaces, desks and office systems. The fixtures or other display items are attached to the baseboard 102 by conventional means, which may include a series of bolts or screws. Display items may also rest on the foot section 6 of the frame 2.

In a commercial environment, such as a retail environment, for example, the display items or fixtures are arranged to display suites of fixtures that would normally be found together in a specific part of a living space, a home or office, for example. Examples of fixtures suites include kitchen fixture suites, bathroom fixture suites, living room fixture suites and office fixture suites. Fixtures, such as those listed above, can be combined to provide the layout of one of these or other living areas. The fixtures that make up a fixture suite are typically matched or coordinated to provide an aesthetically pleasing arrangement.

The fixtures may also be attached to the baseboard 102 by means of connectors which allow the fixtures to be quickly and conveniently attached to the baseboard 102. Such connectors can be of any of a number of types that, when attached to a fixture and/or the baseboard 102, allow the fixture to be quickly and easily attached to the baseboard 102 of the display. A variety of such connectors, one type being pin connectors, are well known in the art. In one embodiment, the baseboard 102 of the display apparatus has a grid of connectors along the baseboard 102 surface, such that any suite of fixtures can be quickly and conveniently attached to the baseboard. Such a grid of connectors allows different fixture suites to be swapped in and out of the display in such a way that the display items of a display are changed, but not the frame 2 and baseboard 102.

Figure 6:
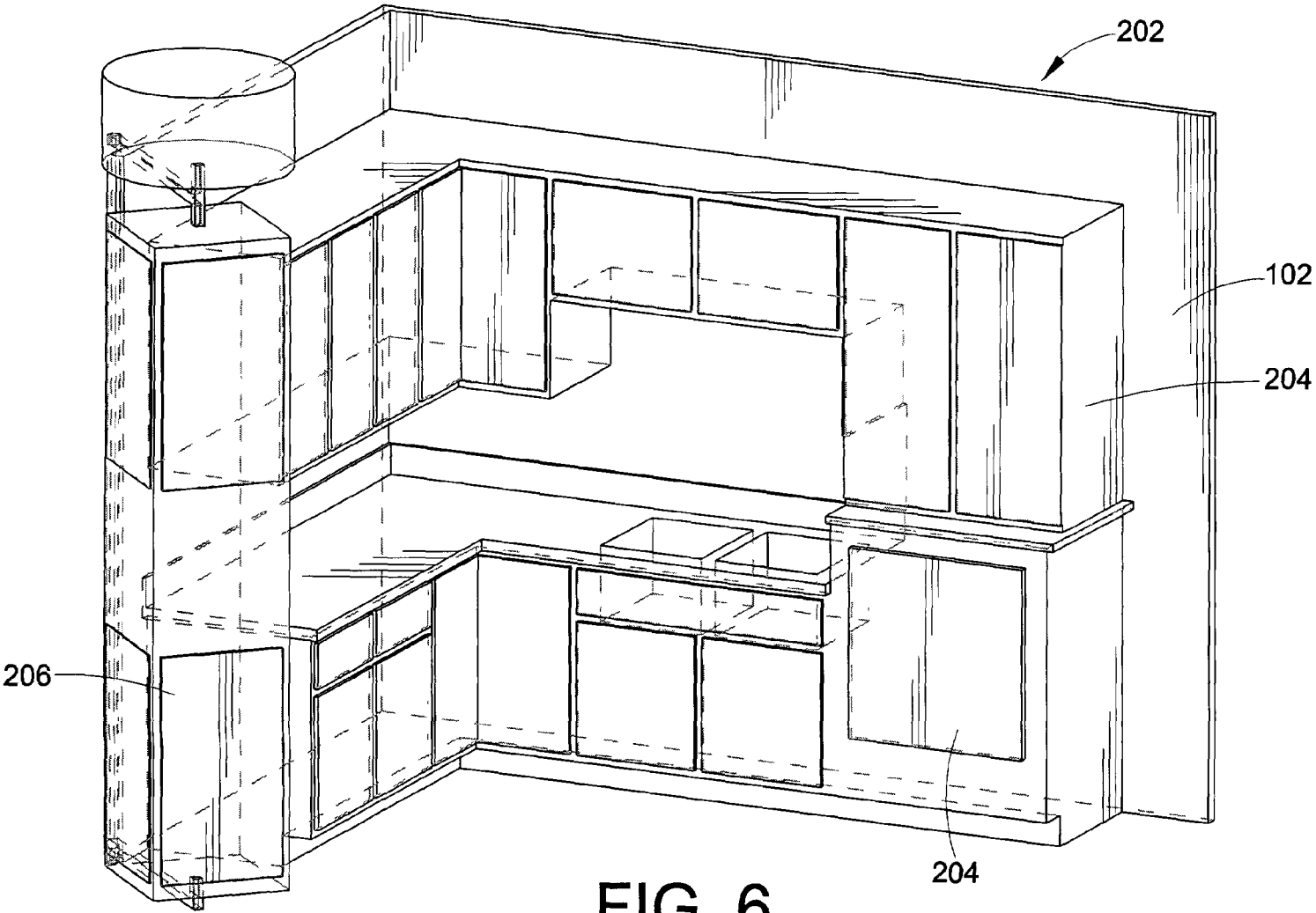
FIG. 6 illustrates a display apparatus as arranged in a commercial environment.

FIG. 6 illustrates an assembled fixture display apparatus 202. The assembled fixture display apparatus 202 includes a fixture suite 204, here a kitchen fixture suite, attached to the baseboard 102 covered display section 4 of the frame 2 of the apparatus. While the figure shows a kitchen fixture suite, it should be appreciated that any of the above-described suites can also be used. FIG. 6 also illustrates the modular aspect of the display apparatus. As shown in FIG. 6, two separate display apparatuses are arranged at right angles to one another to form an arrangement that resembles a region of a living space where two walls come together. As shown in FIG. 6, when the separate display apparatuses are arranged in this way, the displayed cabinets or countertops meet at the connection of the two displays to form a continuous set of cabinets and countertops.

The separate display apparatuses arranged as in FIG. 6 are connected together through pin frame connectors 302 that are part of the baseboard 102 of each display. The pin frame connector 302, shown in FIG. 7, is preferably two steel rods, spot-welded to a flat bar. As shown in FIG. 8, pin frame connectors 302 are press-fit or friction-fit into engagement with two adjacent open ends of the square support bars 8 forming the frame. Multiple pin frame connectors 302 are used as necessary and are simply forced into engagement with the aligned frames.

A display apparatus, or connected display apparatuses, can optionally include electrical connections or plumbing connections for attachment to fixtures. In another embodiment, the display apparatus has a bottom surface. The bottom surface is preferably plywood or particle board and is parallel to and in contact with the floor on which the display apparatus rests. The bottom surface provides a surface that can be covered with carpet, linoleum, tile, or some other flooring surface. Preferably, the floor is connected to the frame 2 of the fixture display apparatus and provides an area for customers viewing the display apparatus to walk upon and it adds to the aesthetic value of the display. In still another embodiment, the display apparatus has a ceiling. The ceiling is preferably plywood or particle board and is parallel to the floor on which the display rests. The ceiling is preferably attached to the top of the display section 4 of the frame, more preferably attached a top structural support bar of the display section 4 of the frame. The ceiling can be covered with paint, for example. The ceiling is used to attach a light fixture.

Additionally, the display may include one or more end caps 206 (FIG. 9). End caps are attached to the ends of the display apparatus (FIG. 6). The end caps have at least two display surfaces 402, and the embodiment shown in the figures has four end cap display surfaces 402. The display surfaces are arranged about a center axis, wherein a foot 404 is placed to allow rotation thereupon. Similar to the baseboard 102, the display surfaces 402 can be painted, wallpapered or otherwise covered. The end cap 206 has a support structure 408 that is attached to the axis of the end cap 206 to the end of the frame. Different types of doors, drawers, handles or other displayed items or accessories can be affixed to the end cap display surfaces 402, via conventional means such as bolts or screws, to allow for viewing of other types of cabinets appearances. Additionally, promotional material, such as advertisements or brochures can be placed on the display surfaces. In one embodiment, a promotional sign 406 is attached atop of the axis of the end cap 206. As shown in the figures, this sign can be cylindrical in nature. Optionally, drawers, doors or shelves can be attached to, or are part of the end caps. Such drawers, doors or shelves can also be used to hold promotional material, which can be picked up by customers as they view the displayed items.

The end caps 206 may also be used for housing or holding a computer station which may comprise a personal computer or a computer terminal for the purpose of interacting with the consumer. In one embodiment, the consumer inputs various information into the computer and data is displayed or printed based on the input. For example, a consumer inputs a particular type, style, color or finish of fixtures that he or she is interested in and the computer displays a list, drawings or pictures of the particular fixture suite that conforms to the interest of the consumer. The price, availability, bill of materials and so forth, for the particular fixture suite of interest may also be displayed. In another example, a consumer inputs a floor plan and/or measurements of the particular room or rooms in his or her home in which the consumer is shopping for fixtures. In response to the input, the computer station displays one or more suites of fixtures that conform to the specifications input by the consumer. In this latter example, the consumer does the initial design work required for outfitting the particular room or rooms of his or her house with new fixtures at the computer station.

As described above, two or more display apparatuses 202 can be connected together to form a modular display apparatus, such apparatus serving to display a single suite or multiple suites of fixtures (FIGS. 10 and 11). Multiple modular apparatuses, each displaying a separate fixture suite, can be arranged to cover a floor space in a commercial environment, as discussed later (FIGS. 12 and 13).

The invention also concerns a method for displaying fixture suites in a commercial environment. The inventive method uses the display apparatus described above and involves full or partial assembly of the apparatus, transport of the apparatus to the site where it will be displayed and then arrangement of the display in the commercial space.

Assembly of the display apparatus involves attachment of the display section 4 of the frame 2 to the foot section 6 of the frame 2. Such attachment results in formation of an "L-shaped" frame 2 configuration as described above. A baseboard 102, typically plywood, is then attached to the frame 2 via conventional means, bolts for example, as described above.

In one embodiment, the various display items are then attached to the baseboard 102 using conventional means, preferably bolts and screws, or by the connectors described earlier that allow the fixtures to be quickly attached to the baseboard 102. The fully assembled display is then transported to the commercial site where the display will be arranged.

In another embodiment, the display apparatus is partially assembled before it is transported to the commercial site. For example, the frame 2 of the display unit may be assembled (display section 4 of frame 2 connected to the foot section 6) and the baseboard 102 attached. The assembled frame 2 and baseboard 102 is then transported to the commercial site. At the commercial site, the display items are attached to the assembled frame 2 and baseboard. The fully assembled display apparatus is then arranged in the commercial floor space.

Transport of either the fully assembled or partially assembled display apparatus to the commercial location is similarly performed. In order to safely transport the display, certain measures are taken to secure the assembly, including securing loose items, such as shelves, placing additional support brackets about the cabinets, and wrapping the display in a removable protective wrap, such as shrink wrap, to secure the cabinets and protect against scratching. The displays are then moved on modified incline dollies or modified piano movers and transported on trucks, or other vehicles, preferably ones with an automatic or hydraulic lift. Once they arrive at their destination, the displays are offloaded and moved into location. The transportation wrapping and braces are then removed, and can be reused if a similar display is being removed for an updated version. Depending on the state of assembly when the apparatus left the production facility, some assembly may have to be done at the retail site.

Once arranged and in place at the commercial site, the displays can be connected, if desired to form larger displays, including connecting two displays at approximately right angles (FIG. 6). While the frames may be connected by conventional connection means, including bolts, hinges, or biscuit joints, in a preferred embodiment, the frames are joined by pin frame 2 connectors (FIGS. 7 and 8). When the displays are connected at an approximate right angle, thereby forming an "L-shaped" joined display unit, the cabinets, countertops and the like can be made to fit together so as to define a continuous set of cabinets or a continuous countertop.

The displays can then be arranged in various configurations to allow for efficient use of floor space (FIGS. 10 and 11). One embodiment has six total displays, wherein two sets of two are connected to form two "L-shaped" joint display units. These joint display units can then be arranged opposite and inverse to one another to form a "Z-shaped" configuration, with the displays all facing outward (FIG. 12). The two additional displays can then be placed back-to-back with the uncovered displays, thereby completing the "Z-shaped" design. The "Z-shaped" design permits the display of four different packages or styles of cabinets to be displayed, two full size, the "L-shaped" portions, and two smaller size, the two individual displays. In the "Z-shaped" configuration or design, up to six end caps can be used to supplement the display. In another embodiment, only one "L-shaped" joint display unit is employed, and two single displays are placed back-to-back with the displays of the "L-shaped" joint display. In this configuration, three packages or styles of cabinets can be displayed, one on the "L-shaped" joint display and one on each of the single displays. A floor layout with various displays is shown in FIG. 13.

An optional additional step to the method of displaying the cabinets includes wiring electrical cables along the top of the display, or in between the frames of two back-to-back displays. Electrical outlets or hook-ups can therefore be provided at various points in the display depending on where they are desired.

The present invention display can be constructed off site and then moved into location with relative ease and with minimal additional construction. Thus, display units can be set up in a relative short amount of time and with minimal to no inconvenience to the store or its customers. The relative ease of moving the display allows for changing out old units with newer displays showing newer models of cabinets. The modular display units can be configured to minimize the amount of floor-space allocated per display, thereby permitting more display units per square area then otherwise achievable.

We claim:

1. A fixture display system comprising:

a frame comprising an upright portion and a portion forming a plane that lies flat against the ground and is substantially perpendicular to the upright portion;

one or more baseboards attached to said frame;

one or more display items affixed to said base-board; wherein said display items include at least one structure that rests on and is supported by said portion that lies flat against the ground; and a rotatable end cap attached to a side portion of said frame by a support means.

2. The fixture display system of claim 1 wherein said rotatable end cap comprises two or more display panels.

3. The fixture display system of claim 2 wherein said rotatable end cap comprises a foot located at a base of the end cap at a center of axis of the end cap.

4. The fixture display system of claim 1 further comprising one or more sets of display drawers or doors attached to said end cap.

5. A method of displaying cabinets, countertops, and the like comprising the steps of:

forming a structural frame;

securing a baseboard to said frame by any conventional securing means;

fastening one or more display items to the baseboard by any conventional securing means thereby forming a display;

transporting the display to a location of sales;

setting the display in the location of sales; and attaching an end cap to the display, wherein the end cap comprises two or more display panels which are connected to the display by a support structure and wherein the end cap rests on a foot at the center of axis of the end cap such as to allow the end cap to rotate the display panels.

6. The method of claim 5 further comprising the steps of forming at least one additional display and arranging said display and said at least one additional display separately or as a joined unit.

7. The method of claim 6 wherein pin frame connectors are used to join two displays together.

8. The method of claim 6 wherein the displays are set up back-to-back with the display items facing outward in opposite directions.

9. The method of claim 6 wherein the displays are connected together at approximately a right angle.

10. The method of claim 6 wherein a total of six displays are arranged such that two sets of two displays are connected at approximate right angles and are placed opposite and inverse to one another and two other display units are placed against the back of the free sides of the connected displays.

11. A fixture display system comprising:

two or more frames, each frame having a set of ends, wherein said two or more frames are connected at one of each of their respective ends at approximate right angles by a means for connecting said two or more frames, wherein each of said two or more frames comprise an upright portion and a portion forming a plane that lies flat against the ground and is substantially perpendicular to the upright portion;

one or more baseboards attached to said frame;

one or more display items affixed to said base-board; wherein said display items include at least one structure that rests on and is supported by said portion that lies flat against the ground.

12. A method of displaying cabinets, countertops, and the like comprising the steps of:

forming a structural frame;

securing a baseboard to said frame by any conventional securing means;

securing one or more display items to the baseboard by any conventional securing means thereby forming a display;

transporting the display to a location of sales;

setting the display in the location of sales; and attaching an end cap to the display, wherein the end cap comprises two or more display panels which are connected to the display by a support structure and wherein the end cap rests on a foot at the center of axis of the end cap such as to allow the end cap to rotate the display panels.

13. The method of claim, 5 wherein said fixtures include one or more of base cabinets, cupboards, shelves, drawers, vanities and countertops, refrigerators, dishwashers, microwave ovens and ranges, shelving systems, bookcases, sinks, toilets, showers, spas, lighting fixtures, safes, fireplaces, desks and office systems.

* * * * *